US008499935B2

(12) United States Patent
Hsieh

(10) Patent No.: US 8,499,935 B2
(45) Date of Patent: Aug. 6, 2013

(54) FIXED SEAT FOR A TOOL

(76) Inventor: Chih-Chien Hsieh, Taichung (TW)

( * ) Notice: Subject to any disclaimer, the term of this patent is extended or adjusted under 35 U.S.C. 154(b) by 72 days.

(21) Appl. No.: 13/238,275

(22) Filed: Sep. 21, 2011

(65) Prior Publication Data

US 2013/0068643 A1 Mar. 21, 2013

(51) Int. Cl.
*B65D 73/00* (2006.01)

(52) U.S. Cl.
USPC ..... 206/378; 206/349; 211/70.6

(58) Field of Classification Search
USPC ..... 206/378, 377, 372, 373, 349, 493; 211/70.6
See application file for complete search history.

(56) References Cited

U.S. PATENT DOCUMENTS

| | | | | |
|---|---|---|---|---|
| 5,740,911 | A * | 4/1998 | Chou | 206/378 |
| 6,032,797 | A * | 3/2000 | Kao | 206/378 |
| 6,070,745 | A * | 6/2000 | Dembicks | 211/70.6 |
| 6,672,555 | B2 * | 1/2004 | Chang | 248/317 |
| 7,264,213 | B2 * | 9/2007 | Liu | 248/309.1 |
| 7,603,803 | B2 * | 10/2009 | Wheeler et al. | 40/617 |
| 2003/0019775 | A1 * | 1/2003 | Ernst | 206/378 |
| 2005/0126943 | A1 * | 6/2005 | Liu | 206/378 |
| 2005/0230587 | A1 * | 10/2005 | Yang | 248/314 |
| 2006/0254940 | A1 * | 11/2006 | Mu et al. | 206/378 |
| 2011/0048989 | A1 * | 3/2011 | Winnard | 206/378 |

* cited by examiner

*Primary Examiner* — David Fidei
(74) *Attorney, Agent, or Firm* — Egbert Law Offices, PLLC

(57) ABSTRACT

A fixed seat for a tool has a sleeve joint pillar set into a polygonized pillar, of which the circumference side part contains abutment surfaces and edges. The abutment surface can abut the groove wall of the sleeve's square casing groove, and said edge or margin part permits spanwise locking of the sleeve during its rotation. A positioning convex part is protruded from an abutment surface on the circumference side part of the sleeve joint pillar, and interlocked with the positioning concave camber on the groove wall of the square casing groove. A lateral through-hole is set onto one side of the sleeve joint pillar. Both ends of the lateral through-hole pass through separately the abutment surface on the circumference side part of the sleeve joint pillar. A wall rim is formed between the abutment surface and the lateral through-hole, so that the positioning convex part could be squeezed flexibly.

8 Claims, 9 Drawing Sheets

FIXED SEAT FOR A TOOL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a fixed seat for a tool, and more particularly to an innovative one which permits location of the sleeve by means of rotary fastening.

2. Description of Related Art Including Information Disclosed Under 37 CFR 1.97 and 37 CFR 1.98.

The fixed seat for a tool referred to herein is an auxiliary seat for locating a sleeve. The configuration of such fixed seat may vary from different sleeves, e.g.: single- or multiple-piece arrangement with use of lifting subs or retaining frames.

Said fixed seat for a tool is structurally configured in a way that a square pillar is generally protruded from the seat body for setting of a square casing groove on one end of existing sleeve. The sleeve is positioned by the proper mating of said square pillar with the square casing groove. Yet, the following shortcomings are still observed during actual applications.

It is very difficult to control the mating tightness of the square pillar and square casing groove in the manufacturing process, since any dimensional error of either the square pillar or square casing groove will affect the sleeving tightness. In the event of extreme tightness, the users may find it inconvenient to take, assemble or place the sleeve. Conversely, loose mating of the square pillar and square casing groove will lead to unstable sleeving and disengagement of the sleeve.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

Based on the unique structural configuration of the present invention wherein the "fixed seat for tool" mainly comprises: a sleeve joint pillar with abutment surface and edge or margin part, positioning convex parts and lateral through-holes, a novel fixed seat for tool is adopted for locating sleeve by means of rotary fastening. The sleeve is rotated in such a manner that the positioning concave camber of the square casing groove is interlocked with the positioning convex part of the sleeve joint pillar, so the positioning convex part presents retraction flexibility when a flexible wall rim is formed with the arrangement of the lateral through-hole. Hence, a bigger mating error is allowed between the sleeve's square casing groove and sleeve joint pillar without affecting the locating robustness of the sleeve. Moreover, this enables to fetch and assemble the sleeve more smoothly, and also improves its locating robustness and operational convenience. On the other hand, with the arrangement of said lateral through-hole, the positioning convex part can be retracted flexibly, so the present invention features simple structure and ease of manufacturing while maintaining satisfactory structural strength of the sleeve joint pillar.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
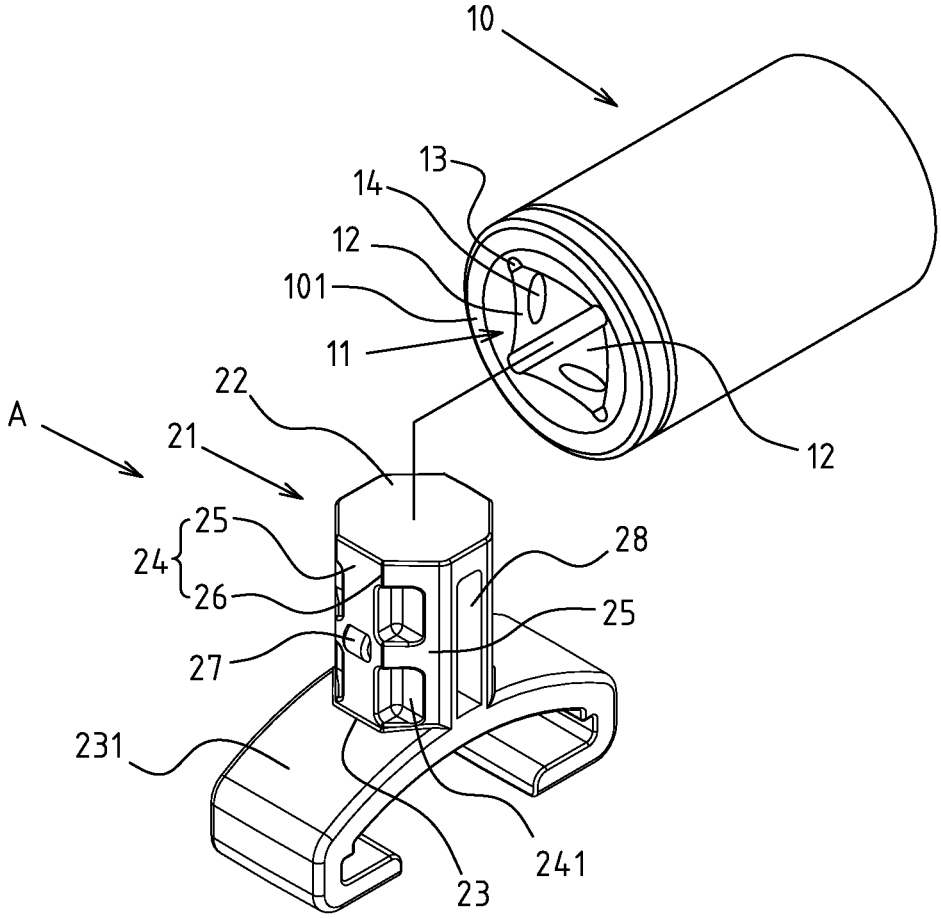
FIG. 1 is a perspective view of the present invention wherein the fixed seat for a tool and sleeve are assembled together.
Figure 3:
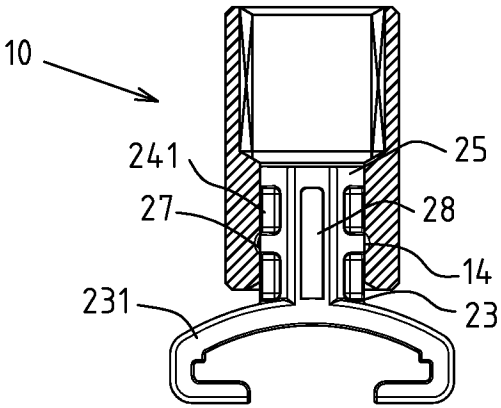
FIG. 3 is an assembled sectional view of the fixed seat for a tool and sleeve of the present invention.
Figure 2:
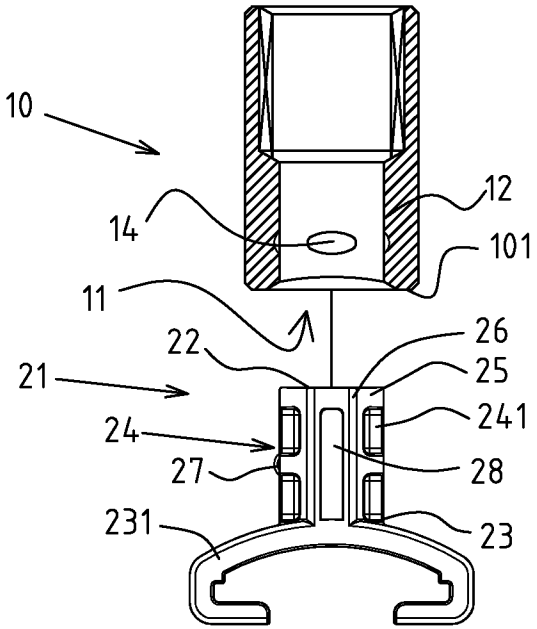
FIG. 2 is an exploded sectional view of the fixed seat for a tool and sleeve of the present invention.

FIGS. 1-7 depict preferred embodiments of a fixed seat of the present invention, which, however, are provided for only explanatory objective for patent claims. Said fixed seat for a tool A is exclusively used for setting and locating the sleeve 10 (including customized and non-customized specifications) by rotary fastening. The toolkit side 101 of said sleeve 10 is provided with a square casing groove 11 to define four groove walls 12 and edges 13 set between the groove walls 12. A positioning concave camber 14 is set deeply onto at least a groove wall 12.

The fixed seat for tool A comprises a sleeve joint pillar 21, set into a polygonized pillar to define a top side 22, a under side 23 and circumference side part 24, of which the circumference side part 24 contains a few abutment surfaces 25 and convex corners 26 formed between the abutment surfaces 25. Said abutment surface 25 can be abutted onto the groove wall 12 of the square casing groove 11 on the toolkit side 101 of the sleeve 10, and said convex corners 26 permits spanwise locking of the sleeve 10 during its rotation, such that the sleeve joint pillar 21 could be tightly mated with the sleeve 10. Moreover, slots 241 are arranged at interval onto the circumference side part 24 for removing feedstock with uniform wall thickness and reducing the sleeving friction area;

At least a positioning convex part 27 is protruded from at least an abutment surface 25 on the circumference side part 24 of the sleeve joint pillar 21. The positioning convex part 27 is interlocked with the positioning concave camber 14 on the groove wall 12 of the square casing groove 11 at the toolkit side 101 of the sleeve 10, enabling secure locking of the sleeve 10.

At least a lateral through-hole 28 is set onto one side of the sleeve joint pillar 21 without positioning convex part 27. Both ends of the lateral through-hole pass through separately the abutment surfaces 25 on the circumference side part 24 of the sleeve joint pillar 21. With the setting of the lateral through-hole 28, a wall rim 29 (shown in FIG. 4) is formed between the abutment surface 25 with positioning convex part 27 and the lateral through-hole 28, so that the sleeve joint pillar 21 could be squeezed flexibly without affecting the overall structural strength.

Figure 4:
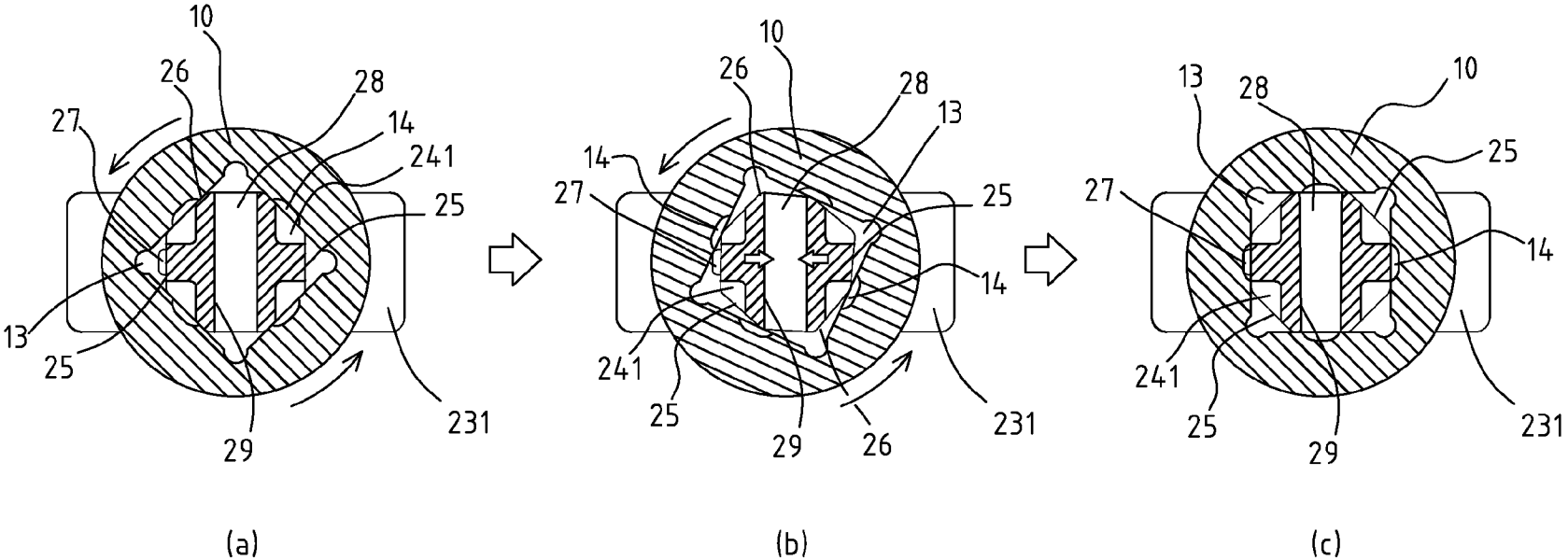
FIG. 4 is a schematic view of the present invention wherein the sleeve joint pillar of the fixed seat for a tool and the sleeve are set and then positioned rotarily.

The service conditions and preferred embodiments of the fixed seat for tool are described below:

Referring to FIG. 4, when the sleeve joint pillar 21 of the preferred embodiment is assembled into the square casing groove 11 on the toolkit side 101 of the sleeve 10 but not rotated, the positioning convex part 27 is positioned at the edge 13 of the square casing groove 11 (indicated by (a) in FIG. 4), and the sleeve joint pillar 21 is squeezed by rotating the sleeve 10, so as to enable retraction of the positioning convex part 27 on the abutment surface 25 of the sleeve joint pillar 21 (indicated by (b) in FIG. 4). Said convex corners 26 and the groove wall 12 in the square casing groove 11 permit spanwise locking. When rotated to a preset angle (45° in this preferred embodiment), the positioning convex part 27 is interlocked with the positioning concave camber 14 on the groove wall 12 of the square casing groove 11 at the toolkit side 101 of the sleeve 10(indicated by (c) in FIG. 4), enabling secure locking of the sleeve 10.

Figure 5:
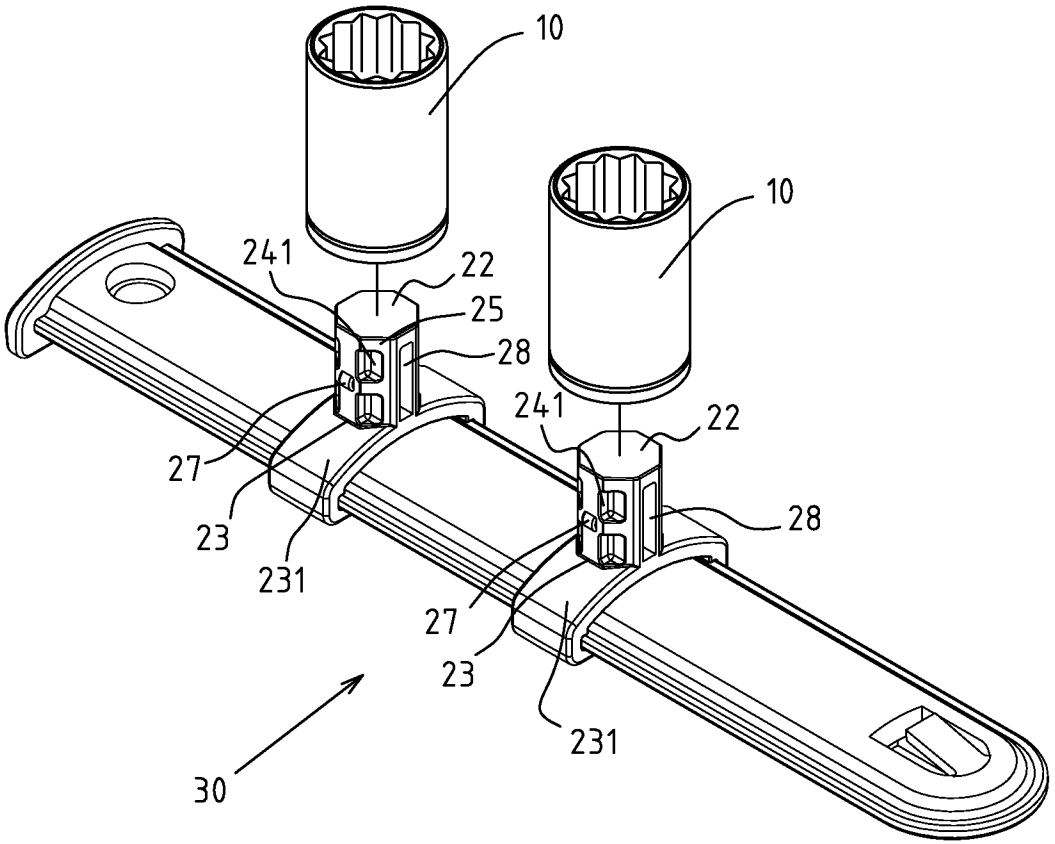
FIG. 5 is a schematic view of the present invention wherein the sliding connector base of the fixed seat for tool is assembled onto the long framework.

Referring also to FIG. 5, a sliding connector base 231 is formed by the under side 23 of the sleeve joint pillar 21, and also sleeved onto a long framework 30 in a sliding state. The long framework 30 can be coupled with several sleeve joint pillars 21 for orderly accommodation and space-saving purposes.

Figure 6:
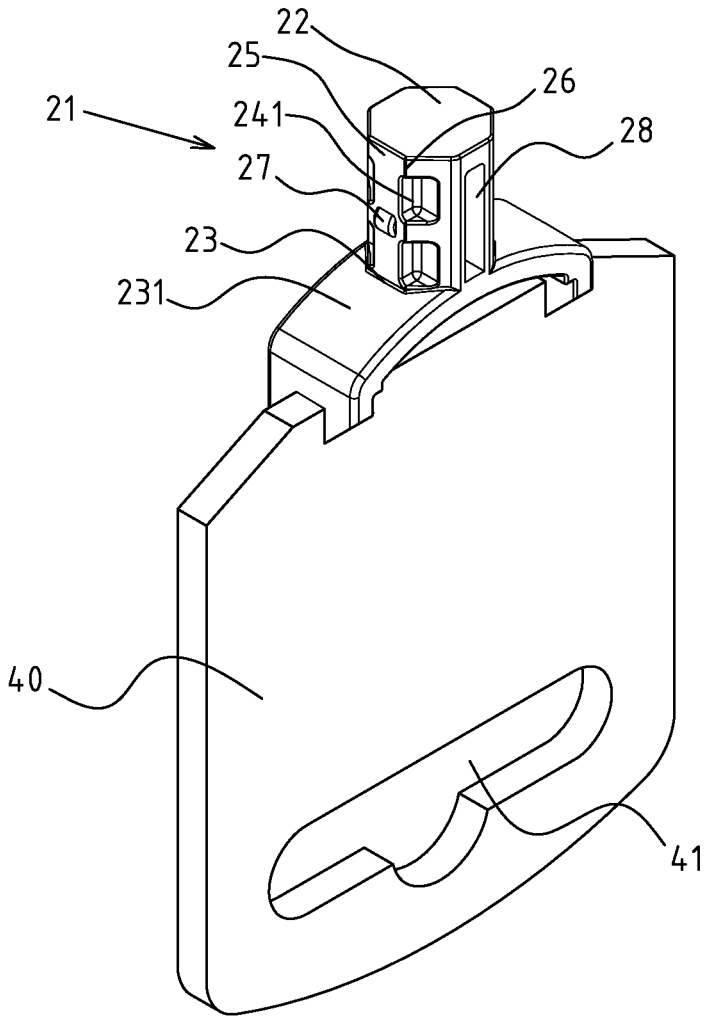
FIG. 6 is a schematic view of the present invention wherein a lifting and clamping portion is formed by the under side of the sleeve joint pillar of the fixed seat for a tool.

Referring also to FIG. 6, another preferred embodiment of the fixed seat for a tool of the present invention, wherein an expanded lifting and clamping portion 40 is formed by the under side 23 of the sleeve joint pillar 21. A lifting hole 41 is set at a preset location of the lifting and clamping portion 40, so as to lift the sleeves 10 on display rack for the consumers.

Figure 7:
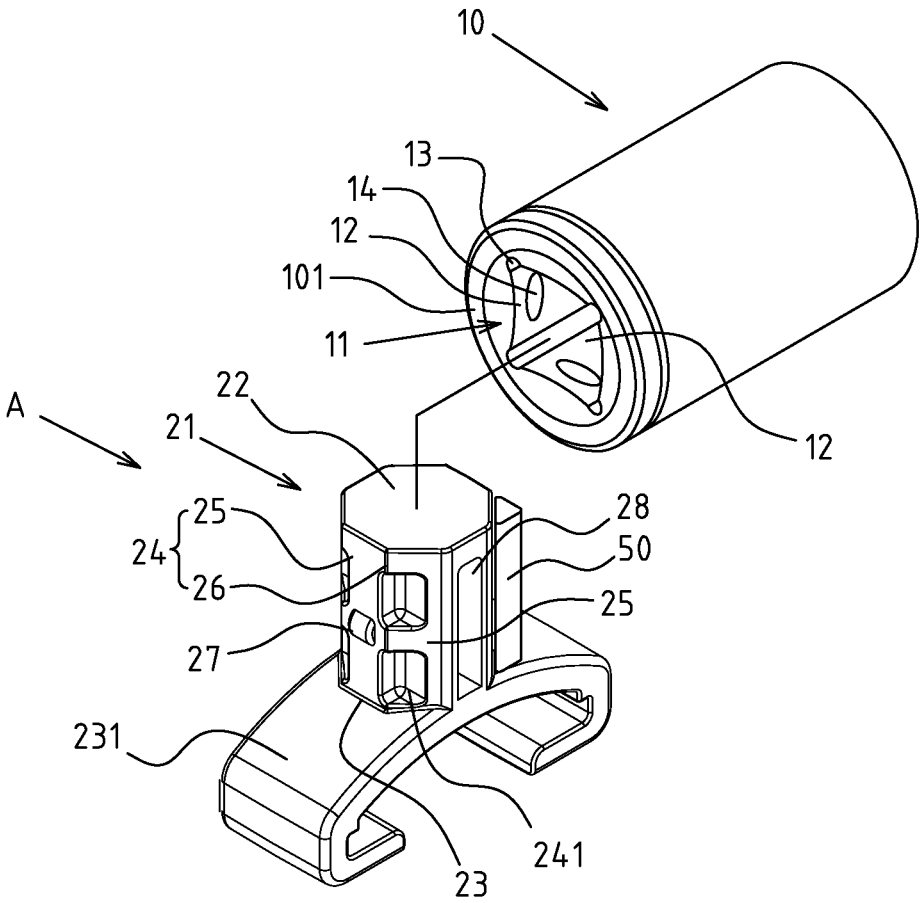
FIG. 7 is a schematic view of the present invention wherein a burglar-proof lock pillar is set on the sleeve joint pillar of the fixed seat for a tool.
Figure 8:
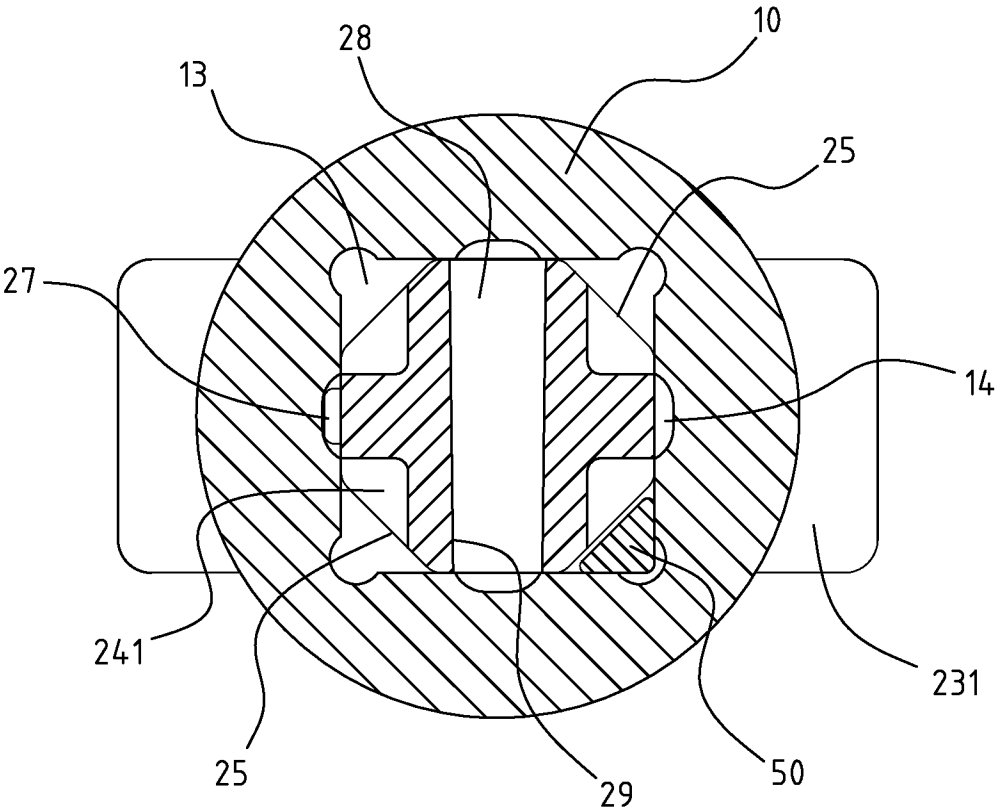
FIG. 8 is a schematic view of the present invention wherein the sleeve joint pillar of the fixed seat for tool and the sleeve are set into an anti-theft state.
Figure 9:
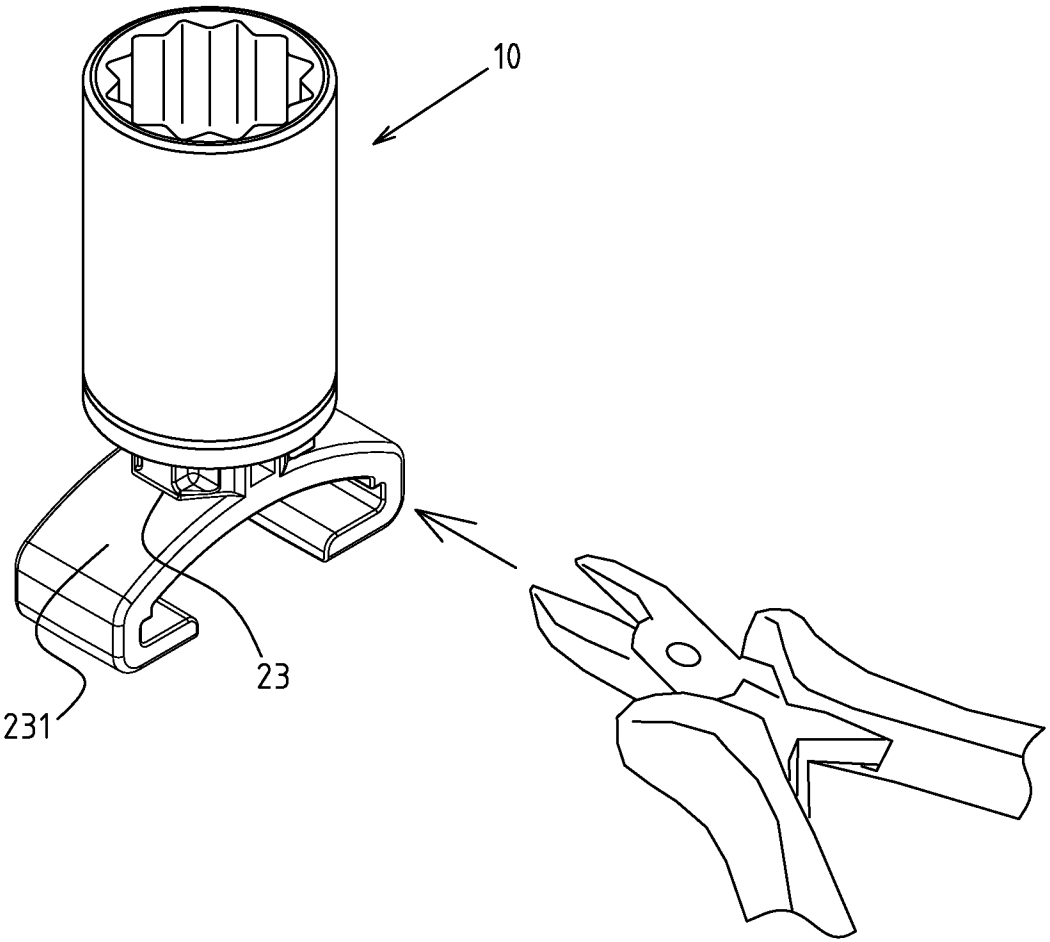
FIG. 9 is a schematic view showing operation of the present invention wherein the burglar-proof lock pillar is removed after the sleeve joint pillar of the fixed seat for a tool and the sleeve are set.

Referring also to FIGS. 7 and 8, another preferred embodiment of the fixed seat for a tool of the present invention, wherein a burglarproof lock pillar 50 is set externally at a spacing with an abutment surface 25 of the sleeve joint pillar 21. The burglarproof lock pillar 50 can also be inserted into a edge 13 of the square casing groove 11 at the toolkit side 101 of the sleeve 10, such that the sleeve 10 can be positioned fixedly to prevent any intended theft. Anti-theft state could be eliminated only when the burglarproof lock pillar 50 is removed (shown in FIG. 9), so the structure without burglarproof lock pillar 50 is resumed as indicated in FIG. 1.

Figure 10:
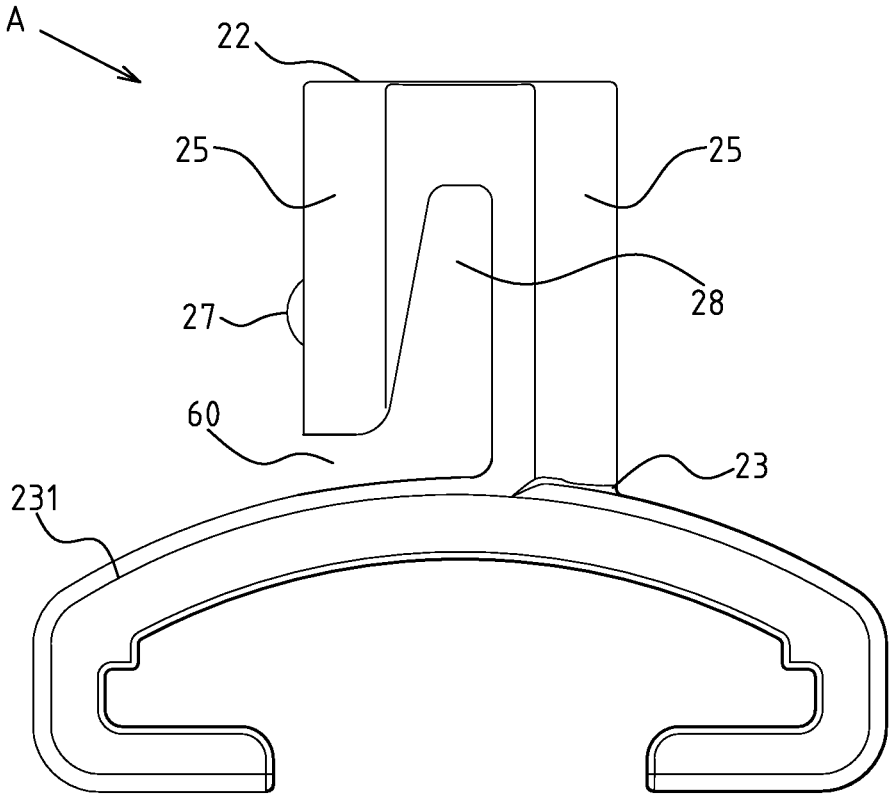
FIG. 10 is a plan view of a preferred embodiment of the fixed seat for tool of the present invention.

Referring also to FIG. 10, another preferred embodiment of the fixed seat for tool of the present invention, wherein a notch 60 is formed laterally on the under side 23 of the sleeve joint pillar 21 with positioning convex part 27, and linked to the through-hole 28, such that the positioning convex part 27 could be squeezed more flexibly.

I claim:

1. A tool assembly comprising:

a sleeve having a groove opening at one end thereof and extending thereinto, said groove having a generally square cross-section in a plane transverse to a longitudinal axis of said sleeve, said sleeve having four walls defining sides of said groove, said sleeve having edges defined between adjacent walls of said four walls, said sleeve having a concave camber formed into at least one of said four walls;

a pillar having a polygonal cross-section in a plane transverse to a longitudinal axis of said pillar, said pillar having a top side and an underside and a plurality of circumferential sides, each of said plurality of circumferential sides having an abutment surface, said pillar having convex corners formed between adjacent abutment surfaces, said abutment surface for abutting the wall of said sleeve, said convex corners allowing rotation of said pillar with respect to said four walls of said sleeve;

at least one positioning part formed on at least one of said abutment surfaces and extending convexly outwardly therefrom, the positioning part interlockable with said concave camber, said sleeve rotatable with respect to said pillar such that the positioning part moves toward said concave camber; and at least one lateral through hole extending from one of said plurality of circumferential sides without the position part thereon to another of said plurality of circumferential sides without the positioning part thereon, the lateral through hole opening at the abutment surface, the lateral through hole defining a wall rim between the abutment surface and the convex corner such that the positioning part can be flexibly squeezed.

2. The tool assembly of claim 1, said underside of said pillar defining a slidable connector base, the tool assembly further comprising:

a framework received slidably by said connector base.

3. The tool assembly of claim 1, said underside of said pillar having an expandable lifting and clamping portion, said lifting and clamping portion having a lifting hole formed therein, the tool assembly further comprising:

a display rack received by said lifting and clamping portion.

4. The tool assembly of claim 1, said pillar having at least a pair of the through holes formed on the abutment surface.

5. The tool assembly of claim 1, further comprising:

a lock member positioned externally relative to the abutment surface, said lock member position adjacent said edges of said groove of said sleeve.

6. The tool assembly of claim 1, said sleeve and said pillar being formed of a metallic material.

7. The tool assembly of claim 1, said sleeve and said pillar formed of a polymeric material.

8. The tool assembly of claim 1, said pillar having a notch formed laterally at said underside of said pillar, said notch communicating with the through hole.

* * * * *